US009032869B2

(12) United States Patent
Harris et al.

(10) Patent No.: US 9,032,869 B2
(45) Date of Patent: May 19, 2015

(54) METHOD FOR APPLYING A STRAP AROUND A LOAD

(75) Inventors: Christopher Harris, Fishers, IN (US); Sean Finley, Indianapolis, IN (US); Richad D. Harris, Indianapolis, IN (US)

(73) Assignee: Systec Conveyors Inc., Indianapolis, IN (US)

( * ) Notice: Subject to any disclaimer, the term of this patent is extended or adjusted under 35 U.S.C. 154(b) by 13 days.

(21) Appl. No.: 13/435,074

(22) Filed: Mar. 30, 2012

(65) Prior Publication Data

US 2012/0247347 A1 Oct. 4, 2012

Related U.S. Application Data

(60) Provisional application No. 61/470,749, filed on Apr. 1, 2011.

(51) Int. Cl.

| | |
|---|---|
| ***B65B 13/02*** | (2006.01) |
| ***B65B 13/06*** | (2006.01) |
| ***B30B 9/30*** | (2006.01) |
| ***B65B 27/12*** | (2006.01) |

(52) U.S. Cl.

CPC ..... *B65B 13/06* (2013.01); *B30B 9/3003* (2013.01); *B30B 9/301* (2013.01); *B30B 9/3071* (2013.01); *B65B 27/12* (2013.01)

(58) Field of Classification Search

CPC ..... B65B 35/44; B65B 51/18; B65B 13/20
USPC ..... 100/2, 3, 7, 26; 53/589, 399, 438, 528, 53/529; 198/604, 620, 626.1
See application file for complete search history.

(56) References Cited

U.S. PATENT DOCUMENTS

| | | | | | |
|---|---|---|---|---|---|
| 3,045,586 | A | * | 7/1962 | Blood | 100/154 |
| 3,179,037 | A | * | 4/1965 | Cranston, Jr et al. | 100/4 |
| 3,327,449 | A | * | 6/1967 | Hullhorst et al. | 53/438 |
| 3,710,536 | A | * | 1/1973 | Lee et al. | 53/399 |
| 3,783,773 | A | * | 1/1974 | Willard et al. | 100/7 |
| 3,824,758 | A | * | 7/1974 | Hart et al. | 53/399 |
| 3,848,398 | A | * | 11/1974 | Suhr | 53/530 |
| 3,948,021 | A | * | 4/1976 | Buck et al. | 53/529 |
| 3,998,150 | A | * | 12/1976 | Buck et al. | 100/269.06 |
| 4,010,680 | A | * | 3/1977 | Buck et al. | 100/152 |
| 2,985,098 | A | | 10/1980 | Winkler | |
| 4,228,733 | A | | 10/1980 | Davis et al. | |
| 4,416,196 | A | * | 11/1983 | Yamada et al. | 100/7 |
| 4,738,078 | A | * | 4/1988 | Benz et al. | 53/439 |
| 4,938,009 | A | | 7/1990 | Takami | |
| 4,989,397 | A | * | 2/1991 | Tomac et al. | 53/528 |
| 5,182,894 | A | * | 2/1993 | Bate | 53/399 |
| 5,189,864 | A | * | 3/1993 | Cinotti et al. | 53/439 |
| 5,400,706 | A | * | 3/1995 | Tipton et al. | 100/4 |
| 5,979,145 | A | * | 11/1999 | Louis et al. | 53/439 |

(Continued)

*Primary Examiner* — Shelley Self
*Assistant Examiner* — Leonel Vasquez
(74) *Attorney, Agent, or Firm* — Maginot, Moore & Beck, LLP

(57) ABSTRACT

In one aspect, the present invention contemplates a strapping station that integrates with a machine for wrapping and clamping a strap around a load, particularly a palletized load. The strapping station includes a transfer conveyor and a compression conveyor that is supported to be lowered onto the upper surface of a load to apply pressure to or compress the load during the strapping operation. The compression conveyor is maintained in that position, continuously applying pressure to the load, even as the load is moved for the application of straps at different locations.

6 Claims, 6 Drawing Sheets

(56) References Cited

U.S. PATENT DOCUMENTS 6,082,254 A * 7/2000 De Vlaam ..... 100/2
6,223,500 B1 * 5/2001 Kramps ..... 53/399
6,318,053 B1 * 11/2001 Frank et al. ..... 53/586
6,397,566 B1 * 6/2002 Tipton et al. ..... 53/529
7,302,781 B2 * 12/2007 Michler et al. ..... 53/399
7,823,368 B2 * 11/2010 Hansen et al. ..... 53/510

* cited by examiner

METHOD FOR APPLYING A STRAP AROUND A LOAD

CROSS-REFERENCE TO RELATED APPLICATION

The present application claims priority to U.S. Provisional Application No. 61/470,749, filed on Apr. 1, 2011, in the name of the same inventors, the entire disclosure of which is incorporated herein by reference.

BACKGROUND

The present disclosure relates to conveyor systems and particularly to conveyor systems having a strapping station at which a load is wound with more than one strap to hold the load together.

Conveyors play a central role in the packaging and transport of sheet products, such as corrugated sheet material. Conveyors carry a newly manufactured sheet to various stations where stacks of sheets are formed and eventually loaded onto pallets for shipment. In some cases, where the sheets are smaller in size, multiple stacks of sheets may be loaded onto a single pallet. Once the sheets have been loaded onto a pallet it is typically necessary to constrain the stacks to retain them on the pallet. Strapping machines are used to automatically wind one or more straps around a palletized load. In most cases, multiple straps are used with the straps spaced uniformly across the length of the load or each stack in a load. The straps are guided through the pallet beams and around the upper surface of the load where they are automatically cinched and clamped in a conventional manner.

In the strapping operation it is important to squeeze or compress the load as the strap is affixed around the load. Prior art systems drop a platen onto the upper surface of the load, applying the strap while the platen remains on the load. The platen is then lifted and the load is advanced to another location, at which point another strap is applied in the same manner. This process may be repeated two or more times for a given load. One problem that arises is that when the platen is lifted the compression of the load is relieved. Thus, on a load that requires multiple straps, the load will be under an uneven force from the strap during the period when the compression is relieved. This uneven loading can cause damage to the load, particularly on the top sheet. In addition, the first strap applied must be strong enough to hold the entire load under compression while the load is situated to receive additional straps. This requires the straps to be stronger than necessary to constrain the load, requiring more material for the straps than is needed.

Furthermore, although the load is squeezed again when the platen is dropped for the next strap, the amount of compression is rarely the same. This leads to multiple straps applying varying degrees of compression on the load. In a worst case scenario, greater compression at one strap may lead to loosening and dislodgment of an adjacent strap. Nominally though, the inconsistent compression leads to an uneven load surface which can create problems if loads are stacked or may compromise the quality of the stacked sheets.

SUMMARY

According to aspects illustrated herein, there is provided a strapping station for applying a strap to a load. The strapping station includes a transfer conveyor configured to transport the load to and from a staging area in a travel direction and a compression conveyor above the transfer conveyor in the staging area, including movable conveyor elements configured to apply a compressive force to the load while the load moves in the travel direction. The station contains a strapping machine located in the staging area configured to position the strap around the load while the compression conveyor applies the compressive force to the load. A first conveyor drive system drives at least one of the compression conveyor and the transfer conveyor to move the load in the travel direction while the compression conveyor applies the compressive force to the load. A compression drive system is provided to move the compression conveyor in a compression direction to apply the compressive force to the load.

In another embodiment, a method of applying a strap to a load comprises positioning a load in a first position on a transfer conveyor in a staging area and engaging a compression conveyor to the load to apply a compressive force to the load. The strap is applied to the load, and the load can then be moved within the staging area while maintaining the compressive force on the load.

DETAILED DESCRIPTION

Figure 1:
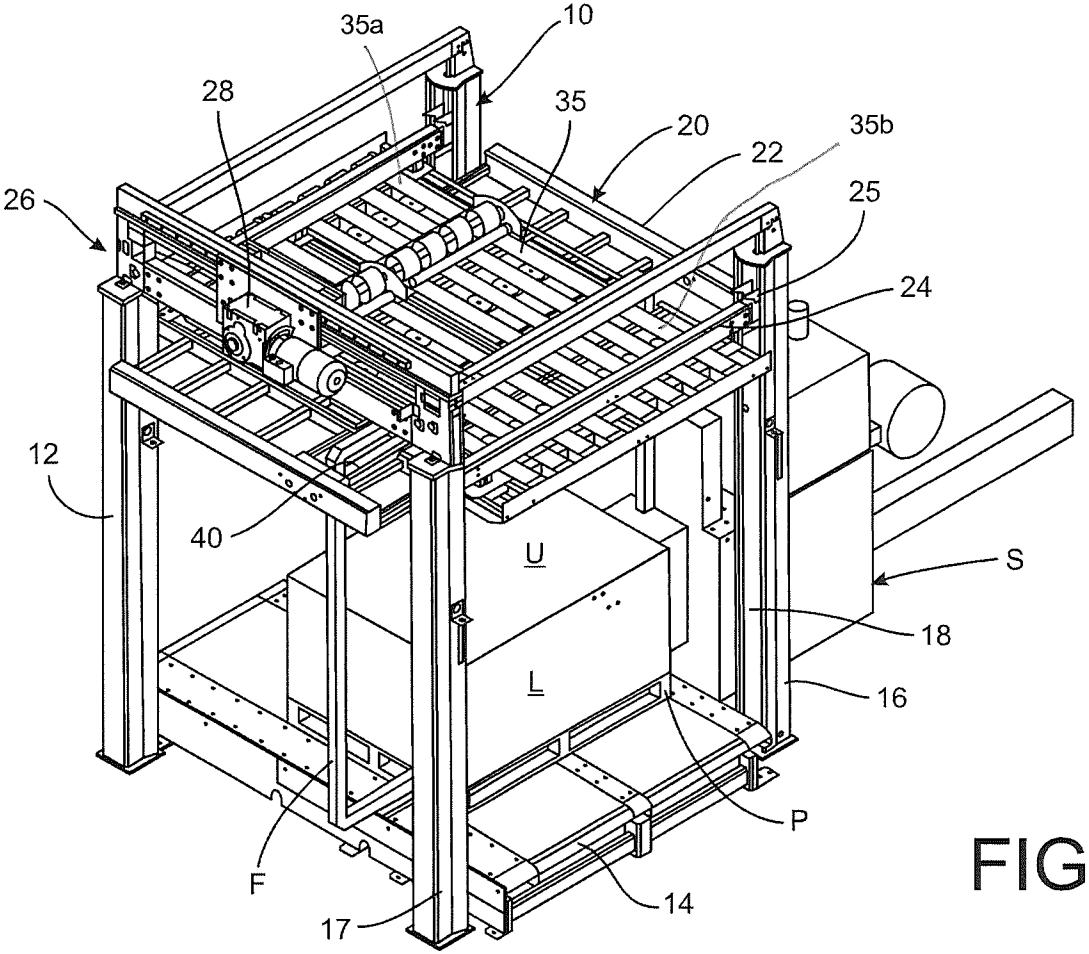
FIG. 1 is a top perspective view a strapping station showing a compression conveyor disengaged from the load.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

As shown in the FIG. 1, a strapping station 10 is defined by a station frame 12 adjacent a strapping machine S. The strapping machine S includes a frame F that encircles a load L positioned within the station 10. The strapping machine S and frame F may be any conventional design capable of tightly winding and clamping a strap around a load or a palletized load, such as the automatic strapping machine described in U.S. Pat. No. 4,938,009 to Takami, the contents of which are incorporated herein by reference.

Figure 2:
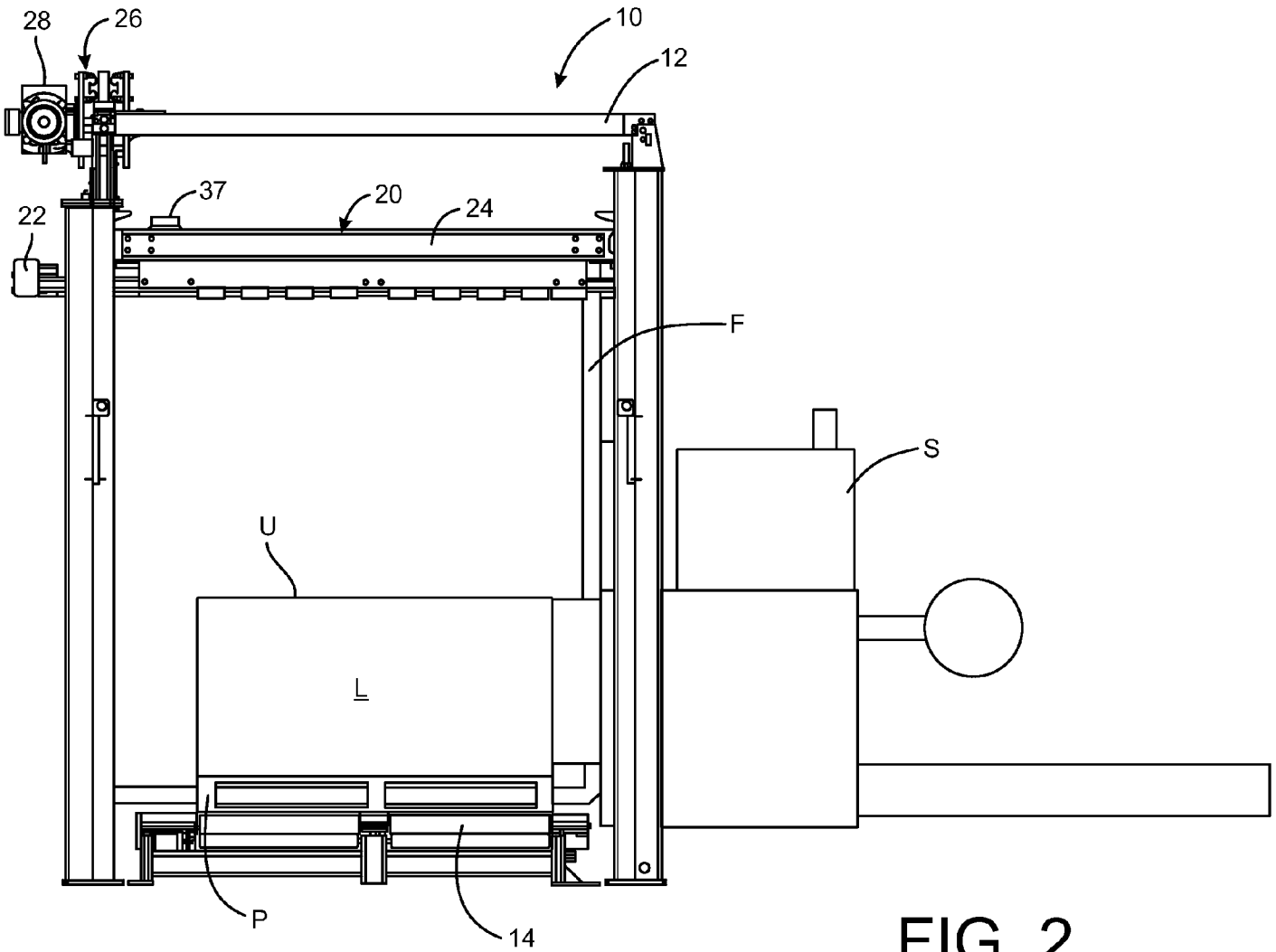
FIG. 2 is an end view of the strapping station of FIG. 1 showing the compression conveyor disengaged from the load.

As shown in FIG. 1, the load L is carried by a pallet P. A transfer conveyor 14 is situated at the base of the station frame 12 of the strapping station 10 and integrates into feed and discharge conveyor sections (not shown) to receive and transfer the palletized load to and from the strapping station 10. As shown in the end and side views of FIGS. 2 and 3, respectively, the frame F of the strapping machine passes through the ribs of the pallet P in a conventional manner, as is described by U.S. Pat. No. 2,985,098 to Winkler or U.S. Pat.

No. 4,228,733 to Davis et al., the contents of which are incorporated herein by reference.

The present embodiment contemplates a compression conveyor 20 that is slidably mounted to the station frame 12. The compression conveyor 20 includes conveyor components suitable for contacting an upper surface U of the palletized load L. For instance, the compression conveyor 20 includes a conveyor frame 22 supporting a series of belts 35 and a conveyor drive 37. The belts 35 may be preferred for a load composed of sheet material, although other types of conveyor elements, powered and non-powered, are contemplated, provided that the elements allow the load to translate while continuously compressing the load.

The compression conveyor 20 includes a slide mount 24 incorporated into each end of the conveyor frame 22. Each slide mount 24 is slidably engaged to vertical beams 16, 17 of the conveyor frame 12 and may also incorporate an end fitting 25 adapted to fit within a slot or channel 18 defined in each vertical beam. In the present embodiment, the compression conveyor includes a slot 40 through which the upper portion of the frame F passes to allow the strap to be placed on the load L through the compression conveyor 20. It can be appreciated that the slot 40 may be defined by a gap between adjacent sections 35*a*, 35*b* of the compression conveyor 35 spaced along the length of the load L.

Figure 3:
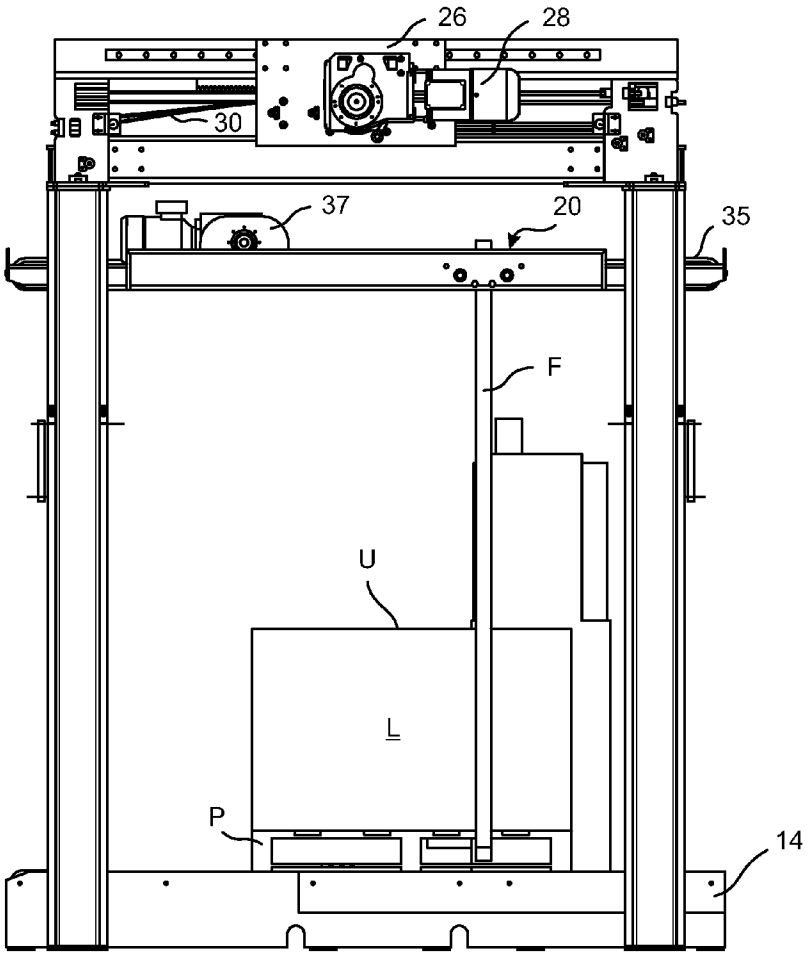
FIG. 3 is a side view of the strapping station of FIG. 1 showing the compression conveyor disengaged from the load.

A compression drive mechanism 26 is provided to raise and lower the compression conveyor 20 within the station frame 12, in a direction orthogonal to a travel direction 50. In one embodiment, the compression drive mechanism 26 includes a compression drive motor 28 mounted to the station frame 12 and a cable system 30 that is fastened to each corner of the compression conveyor 20, preferably to the end fittings 25 with the cables of the cable system 30 contained within the channel 18, as shown in FIG. 3. It can thus be appreciated that the compression drive motor 28 is operated to lower the compression conveyor 20 onto the upper surface U of the load L when the palletized load is positioned within the strapping station 10. As conveyor 20 is lowered it passes along the frame F of the strapping machine S via the slot 40. A reversible motor and appropriate cabling can be used to raise the compression conveyor 20 to relieve the compressive force on the load once the final strap has been applied. In an alternative embodiment, a chain drive system is used in lieu of the cable system.

Figure 4:
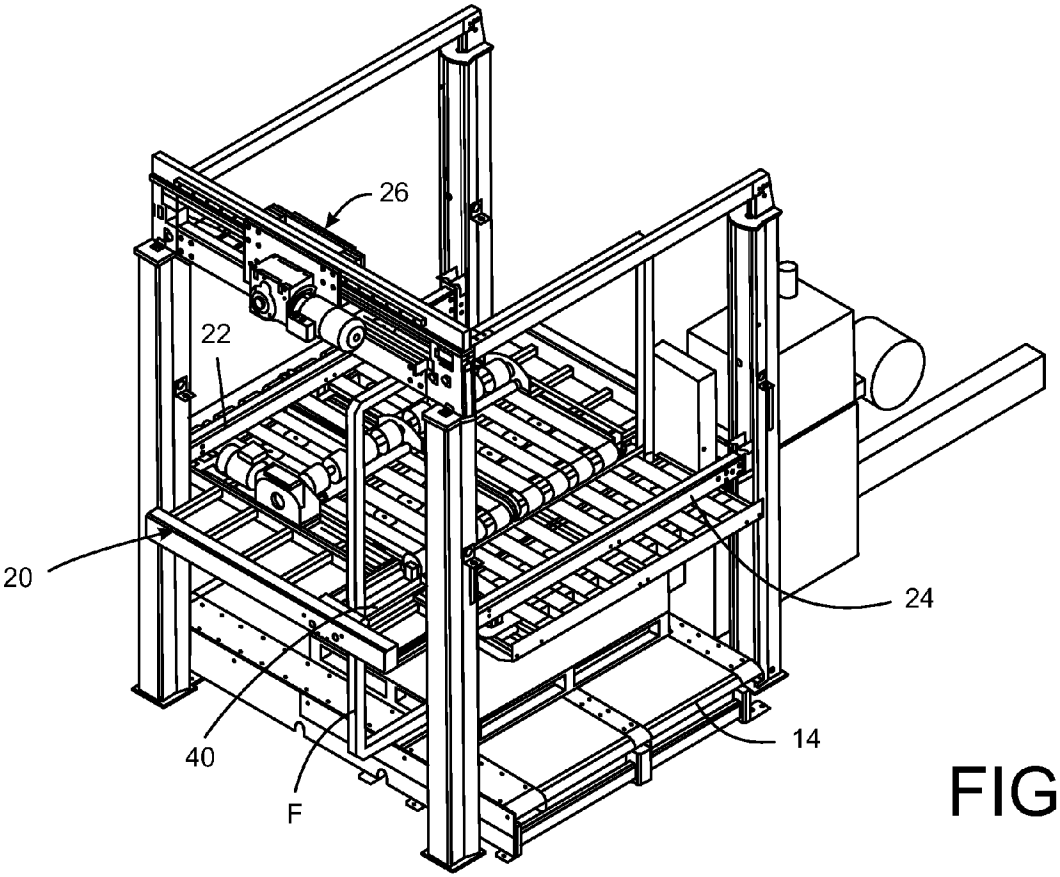
FIG. 4 is a top perspective view the strapping station of FIG. 1 showing the compression conveyor engaged with the load.
Figure 5:
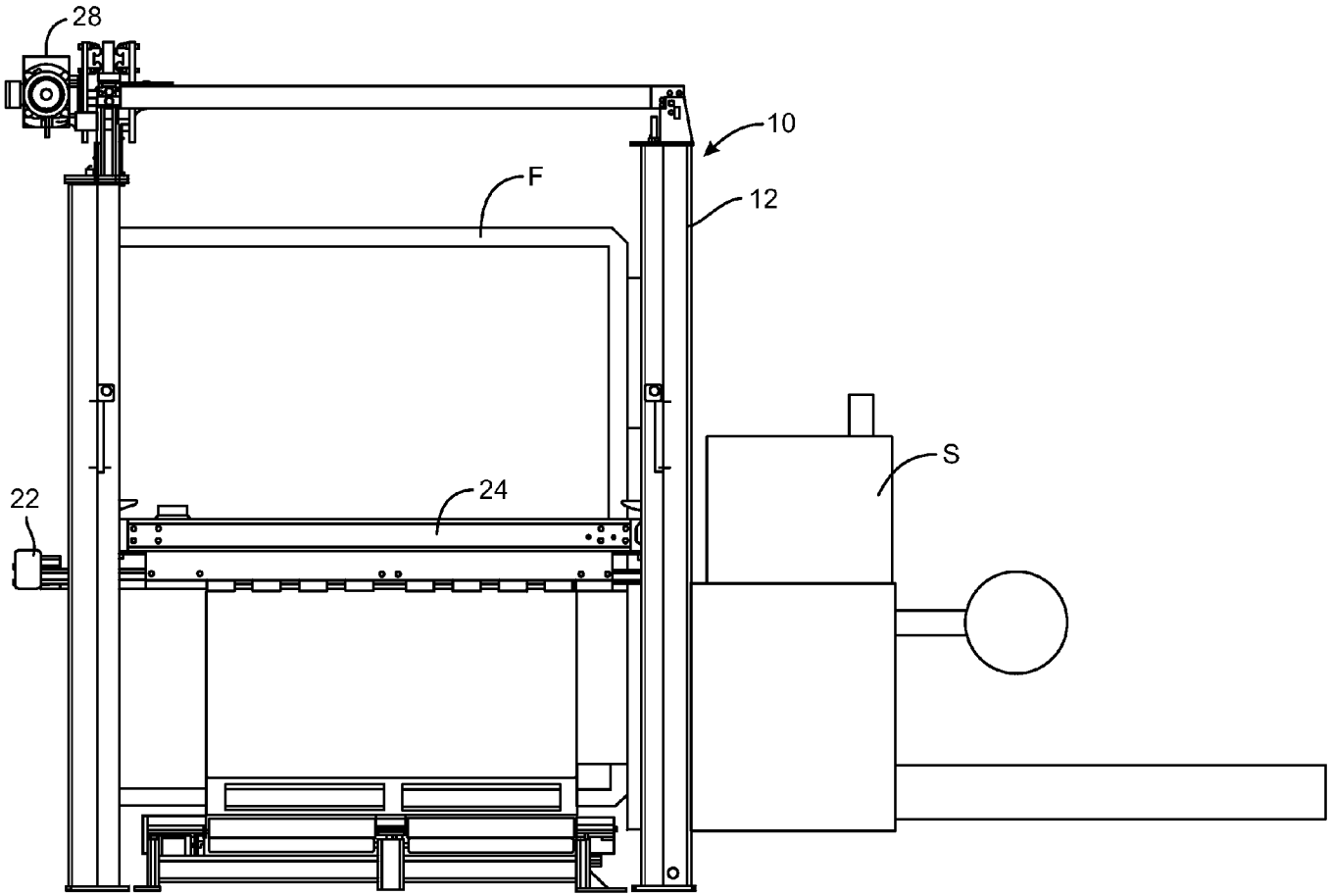
FIG. 5 is an end view of the strapping station of FIG. 1 showing the compression conveyor engaged with the load.
Figure 6:
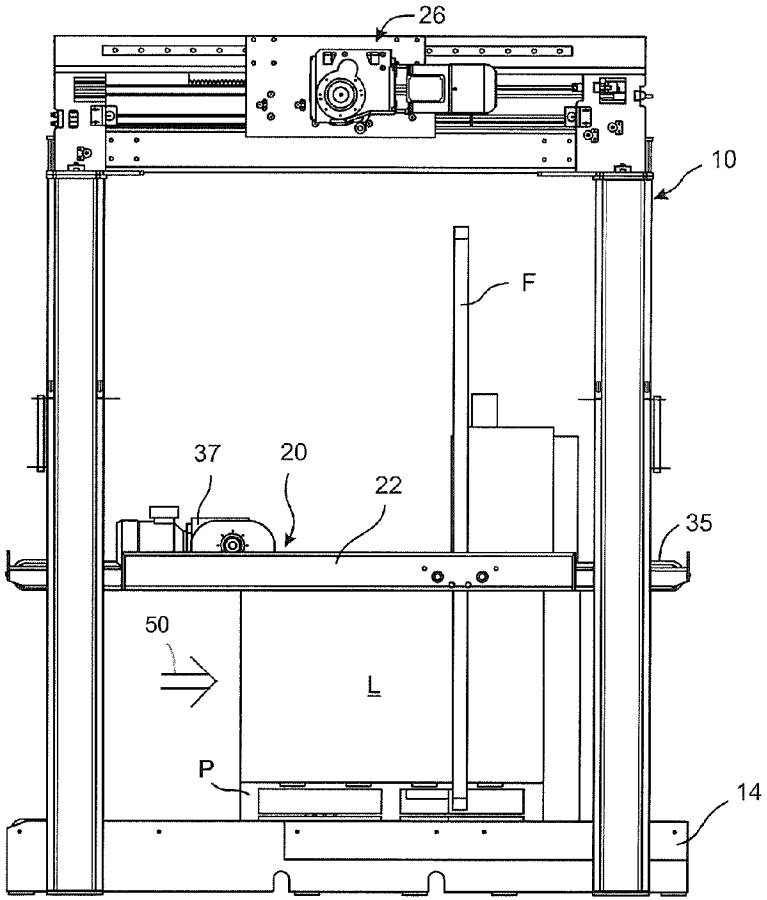
FIG. 6 is a side view of the strapping station of FIG. 1 showing the compression conveyor engaged with the load.

FIGS. 4-6 depict the compression conveyor 20 in the position in which the load L is compressed between the transfer conveyor 14 and the compression conveyor 20. It can be appreciated that the amount of compression that is applied may be based simply upon the weight of the compression conveyor 20. Alternatively, the compression drive mechanism 26 may be configured to apply a specific force independent of the conveyor weight such that the compressive force exerted on the load L is different from the weight of the compression conveyor 20. In one embodiment the cabling system 30 is configured to pull down on the conveyor frame 22 with a predetermined force to apply a known amount of pressure to the upper surface U of the load L. Other drive mechanisms may be provided that are capable of actively compressing the conveyor on the load. The compressive force applied to the load L may be stored in a strapping station controller (not shown), such that multiple types of loads may be strapped under uniform compression.

The compression conveyor 20 is operable to maintain pressure on the load surface U continuously even as the load L is shifted along the transfer conveyor 14 to apply additional straps. Thus, as shown in the side view of FIG. 6, with the load L compressed between the two conveyors 14 and 20, the load is advanced in the travel direction 50 so that the frame F may be aligned with another location along the length of the load. This movement may be accomplished by the compression conveyor 20 by activating the conveyor drive 37 to rotate the conveyor belts 35. Thus, even as the compression conveyor 20 is maintaining a constant compressive force on the upper surface U, it is also applying a longitudinal force to push the load L toward the discharge end of the station 10. Depending upon the strapping convention for the particular load, the conveyor drive 37 may be reversible to move the palletized load backward or forward within the station as needed.

In one specific embodiment, when compression is applied the load L is transferred under power from the compression conveyor 20 only. The transfer conveyor 14 is, in essence, an idler conveyor. In an alternate configuration, both conveyors are powered to move the load L in a coordinated fashion. In yet another configuration, the compression conveyor 20 acts as an idler conveyor, with only the transfer conveyor 14 being powered to move load L in the travel direction 50 while the load L is under compression. The activation of the powered conveyors (such as conveyor drive 37) may be controlled by the strapping station controller. The strapping station controller may be pre-programmed for a specific load and a specific strapping pattern, or may maintain a database of load types and strapping patterns that is accessed based on external data about the load.

Although the illustrated embodiment contemplates a vertical compression, it can be appreciated that one or more compression or transfer conveyors may be placed to compress the load horizontally when applying a strap. For example, compression and transfer conveyors may be placed transverse to the travel direction to compress the load horizontally.

It is further contemplated that the compression conveyor 20 reflects the nature of the transfer conveyor with respect to the motion capabilities. In particular, the two conveyors may be configured to not only translate but also to rotate the load to apply straps crosswise and lengthwise on the load. Alternatively, the transfer conveyor 14 may be configured to rotate the load with the compression conveyor retracted.

The conveyor elements of the illustrated embodiment include conveyor belts to achieve a uniform pressure along the load L. Other conveyor elements are contemplated provided the elements can exert a generally uniform continuous pressure on the load L while the load L is translated along the station 10.

What is claimed is:

1. A method of applying a strap to a load comprising:

positioning a load in a first position on a transfer conveyor in a staging area, the staging area including a compression conveyor positioned over the load in the staging area, the compression conveyor including a compression conveyor frame having first movable conveyor elements supported in a leading portion of the conveyor frame relative to a travel direction and second movable conveyor elements supported in a trailing portion of the conveyor frame relative to the travel direction, the first and the second movable conveyor elements being spaced apart from each other to define a slot that extends across the conveyor frame in a direction transverse to the travel direction, moving the compression conveyor frame toward the load until the first movable conveyor elements and the second moveable conveyor elements contact the upper surface of the load and apply a compressive force to the load, applying a strap around the load through the slot while the first and the second movable conveyor elements are positioned against the upper surface of the load such that the strap extends across the upper surface of the load in the direction transverse to the travel direction, and moving the load in a travel direction within the staging area while the first and the second movable conveyor elements are positioned against the upper surface and maintaining the compressive force on the load.

2. The method of claim 1 further comprising:

moving the load in the staging area to in a second position after applying the strap while the first and the second movable conveyor elements are positioned against the upper surface and maintaining the compressive force on the load, and applying a second strap around the load through the slot while the first and the second movable conveyor elements are positioned against the upper surface of the load such that the second strap extends across the upper surface of the load in the direction transverse to the travel direction.

3. The method of claim 1 wherein:

the compression conveyor includes at least one belt, and moving the load within the staging area is accomplished by moving the at least one belt on the compression conveyor.

4. The method of claim 1 wherein:

the transfer conveyor includes at least one belt, and moving the load within the staging area is accomplished by moving the at least one belt on the transfer conveyor.

5. The method of claim 1 wherein the step of moving the compression conveyor frame toward the load includes powering the compression conveyor frame with a compression drive mechanism.

6. The method of claim 1 wherein the step of moving the compression conveyor frame toward the load includes moving the compression conveyor frame until the first and the second movable conveyor elements apply a compressive force to the load that is greater than the weight of the compression conveyor.

* * * * *